US008056847B1

(12) United States Patent
Sawant et al.

(10) Patent No.: US 8,056,847 B1
(45) Date of Patent: Nov. 15, 2011

(54) ROTATING FEED DISTRIBUTOR

(75) Inventors: Ulhas S. Sawant, Hartland, WI (US); James A. Sheridan, Greendale, WI (US)

(73) Assignee: Innotech Solutions, LLC, Brookfield, WI (US)

( * ) Notice: Subject to any disclaimer, the term of this patent is extended or adjusted under 35 U.S.C. 154(b) by 0 days.

(21) Appl. No.: 12/803,881

(22) Filed: Jul. 8, 2010

(51) Int. Cl.
*B02C 19/00* (2006.01)

(52) U.S. Cl. ..... 241/291; 241/275

(58) Field of Classification Search ..... 241/275, 241/291
See application file for complete search history.

(56) References Cited

U.S. PATENT DOCUMENTS

| | | | |
|---|---|---|---|
| 1,920,488 | A | 8/1933 | Symons |
| 2,207,858 | A | 7/1940 | Gruender |
| 2,656,120 | A | 10/1953 | Roubal |
| 3,212,720 | A | 10/1965 | Gasparac et al. |
| 3,358,939 | A | 12/1967 | Gasparac et al. |
| 3,614,023 | A | 10/1971 | Archer et al. |
| 3,785,578 | A | 1/1974 | Kemnitz |
| 3,813,046 | A | 5/1974 | Kemnitz et al. |
| 3,834,631 | A | 9/1974 | King |
| 3,951,348 | A | 4/1976 | Davis et al. |
| 3,957,213 | A | 5/1976 | Stockman et al. |
| 3,985,308 | A | 10/1976 | Davis et al. |
| 3,985,309 | A | 10/1976 | Davis et al. |
| 4,012,000 | A | 3/1977 | Davis et al. |
| 4,106,707 | A | 8/1978 | Kemnitz |
| 4,575,013 | A | 3/1986 | Bartley |
| 4,662,571 | A | 5/1987 | MacDonald et al. |
| 4,697,745 | A | 10/1987 | Sawant et al. |
| 4,739,937 | A | 4/1988 | Carpenter et al. |
| 4,750,681 | A | 6/1988 | Sawant et al. |
| 4,754,932 | A | 7/1988 | Kmiotek et al. |
| 5,137,220 | A | 8/1992 | Rose et al. |
| 5,277,370 | A | 1/1994 | Schatz |
| 6,129,297 | A | 10/2000 | Sawant et al. |
| 6,213,418 | B1 | 4/2001 | Gabriel et al. |
| 6,227,472 | B1 | 5/2001 | Ryan et al. |
| 7,040,562 | B2 | 5/2006 | Sawant et al. |

*Primary Examiner* — Mark Rosenbaum
(74) *Attorney, Agent, or Firm* — Ryan Kromholz & Manion, S.C.

(57) ABSTRACT

A rotating feed distributor for use in connection with rock crushers and other devices. The feed distributor comprises a platform for receiving rocks and a chute having an inlet and outlet wherein the rocks pass through. The feed distributor is designed to reduce wear by evenly distributing rocks into the crusher. The chute is supported and rotated utilizing a motor, drive belts, a sheave structure, thrust bearings and idler wheels. The sheave structure includes a flange and a face which are generally orthogonal to one another. The belts, thrust bearings and idler wheels each engage with the sheave structure.

20 Claims, 5 Drawing Sheets

ROTATING FEED DISTRIBUTOR

BACKGROUND OF THE INVENTION

This invention relates to cone crushers used for crushing rocks and, more specifically, feed distributors used in combination with rock crushers and other devices.

Generally, a belt conveyor or feeder delivers rocks and stones into a crusher. The rocks will ride up the conveyor, whose end is located above the input of the crusher. The rocks are dumped under the force of gravity into the crusher, which will then break the rocks into a predetermined size. Preferably, the uncrushed rocks will first pass through a feed distributor, which will assist in dispersing the uncrushed rocks into the crusher.

Since rocks fed into the crusher are not always of the same size and shape, they will not necessarily be crushed to a final uniform size. However, it is preferable to have the crushed rocks be within a relative range and size; otherwise the rocks and stones need to be recrushed. Furthermore, the final crushed rock product should preferably have a uniform gradation of rock sizes and shapes, rather than having a batch of stones that may contain very fine dust as a product and another batch that only contains larger rocks. Such segregation of the rocks is not advantageous as it can lead to a less saleable end product. In the event the rocks are too large for specifications, the rocks will be recycled back into the crusher to be crushed again.

To alleviate problems of nonuniformity, previous designs and inventions have focused on improving the crushers so that the resultant crushed rocks will be more uniform in size. However, it has been observed that one of the reasons for inconsistent crushed rock gradation is that the uncrushed rocks are not evenly distributed as they fall into the crusher and instead arrive in the crusher in a segregated fashion. Rocks will generally fall into the crusher under the force of gravity, which means small rocks will fall together and larger rocks will separately fall together. Consequently, the rocks will not be evenly distributed, which leads to potentially uneven crushing of the rocks. Rocks outside of a predetermined range will need to be recycled or re-crushed, which is not an efficient process.

Premature wear of the specific parts of prior feed distributors is also a problem. When rocks fall upon the feed distributor and the chute used in the distributor, the impact tends to wear and erode the feed distributor's components. The rock crushing environment creates excess and abrasive dust which can also lead to premature wear of certain machine elements, such as bearings. As a result feed distributor components need to be replaced, which leads to more downtime of the system and, consequently, reduces the efficiency of the overall system.

Previous inventions, such as Sawant et al., U.S. Pat. No. 7,040,562, owned by the same assignee as the present invention, disclose rotating feed distributors. However, depending upon the environment where it is operated, the device in Sawant may require frequent maintenance. This is not desirable as the entire rock crushing process must be halted while the rotating feed distributor is attended to.

Other previous inventions, such as Ryan et al., U.S. Pat. No. 6,227,472, discuss devices that will spin rocks into the sides of the crusher. However, the device in Ryan causes buildup within the device, and, since the device is located within the crusher, is not easily cleaned or serviced. Other devices, such as Kemnitz, U.S. Pat. No. 4,106,707, contemplate feed distributors, but do not allow for control and efficiency as is found in the present invention. Furthermore, prior art designs have been observed to comprise drive means that are susceptible to dust and dirt and may unduly slip when driving the feed distributor, such as Gasparac et al., U.S. Pat. No. 3,212,720. The present invention addresses this issue by introducing a system for evenly distributing feed rocks into a crusher.

SUMMARY OF THE INVENTION

The present invention provides an improved feed distributor for use in connection with rock crushers. The feed distributor sits beneath the top end or output end of a conveyor or feeder used in conjunction with a rock crusher. The conveyor or feeder delivers rocks from a supply source to the distributor that is positioned over the crusher. The feed distributor receives the rocks onto its feed platform, where the rocks travel from the feed platform into a feed chute comprising an inlet and an outlet. The feed chute has an outer tube and an inner tube, with the outer tube rotating and the inner tube being relatively stationary. The outer tube is driven by a motor coupled to a gear reducer. The use of the two tubes lessens the wear on the feed distributor. The rotating outer tube allows the rocks to be evenly distributed into the rock crusher and reduces segregation of rock size, which improves the efficiency of the rock crusher and reduces operating cost.

The feed distributor provides for an even distribution of the rocks before entering the crusher, thereby minimizing uneven rock buildup within the crusher and further minimizing the need for recycling or re-crushing of rocks that are not crushed within predetermined size limitations. The feed distributor is further designed to protect the power means, support means and drive system from abrasive dust and other rock particles, thereby reducing the overall wear on the feed distributor. The arrangement of the drive belts and bearings of the feed distributor also provides for a reliable and low maintenance drive system.

The feed distributor includes a sheave structure coupled around the rotating outer tube. The sheave structure has a substantially horizontal flange and a substantially vertical face. Preferably, the flange and face are orthogonal to one another. The sheave structure is supported on its flange by a plurality of thrust bearings mounted to the feed distributor housing. Thus the rotating outer tube is supported by the thrust bearings. The sheave structure receives one or more drive belts driven by a power means, such as a motor and gear reducer assembly. The distance between the power means and rotating outer tube is maintained by a plurality of roller bearings circumferentially arranged about the sheave structure.

The feed distributor improves both the performance and the efficiency of the rock crusher. The design of the feed distributor also consumes less power, reduces wear, extends maintenance intervals, reduces abuse to the crusher and makes more cubical products when compared to prior art feed distributors. This in turn reduces operating cost/ton of product and increases the yield of sellable product tonnage.

DESCRIPTION OF THE PREFERRED EMBODIMENT

Figure 1:
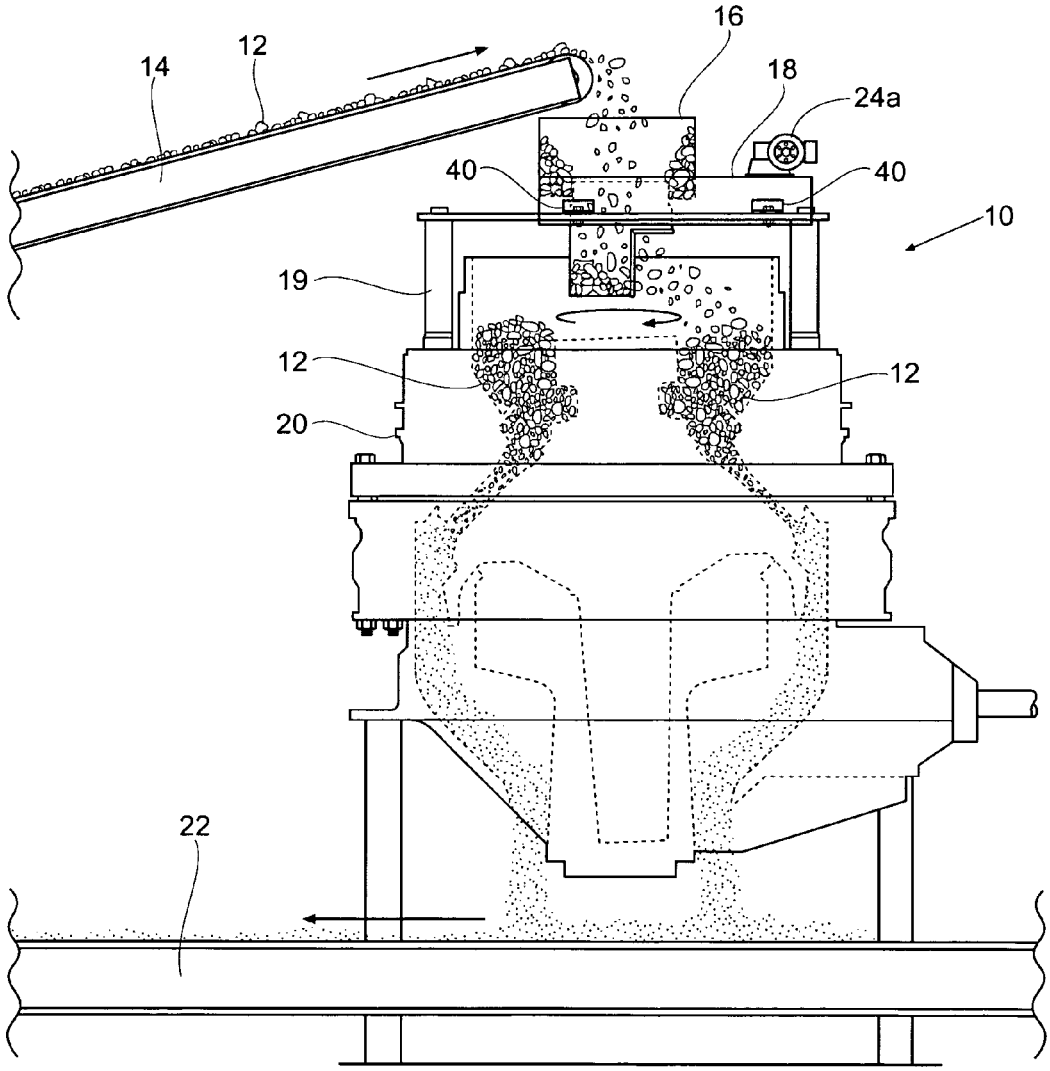
FIG. 1 is a side view of the present invention in combination with a rock crusher and a feed conveyor.

FIG. 1 shows a side view of a rock crushing system 10 employing the present invention. A plurality of rocks 12 is fed upwards on a conveyor 14. The conveyor 14 delivers the rocks 12 through a feedbox 16 and into an improved feed distributor 18, which is the focus of the present invention. The feed distributor 18 is designed for 360 degree rotation and delivers the rocks 12 uniformly to the crusher 20. The distributor 18 may be mounted to the crusher 20, the conveyor 14, or may be mounted independently. A frame or mount 19 holds the feed distributor 18 in place over the crusher 20. The frame 19 can encompass a wide range of shapes and sizes that will adequately mount the distributor 18 over the crusher 20. The feedbox 16 should be considered a stand-alone feature that is not part of the present invention. The feed distributor 18 passes the rocks 12 into the crusher 20, which rotates or gyrates and crushes the rocks 12. The crushed rocks 12 exit below the crusher 20, possibly onto a second conveyor 22, which will then take the crushed rocks 12 away to be used, further sorted, or to be recycled and reprocessed in the rock crushing system 10.

Figure 2:
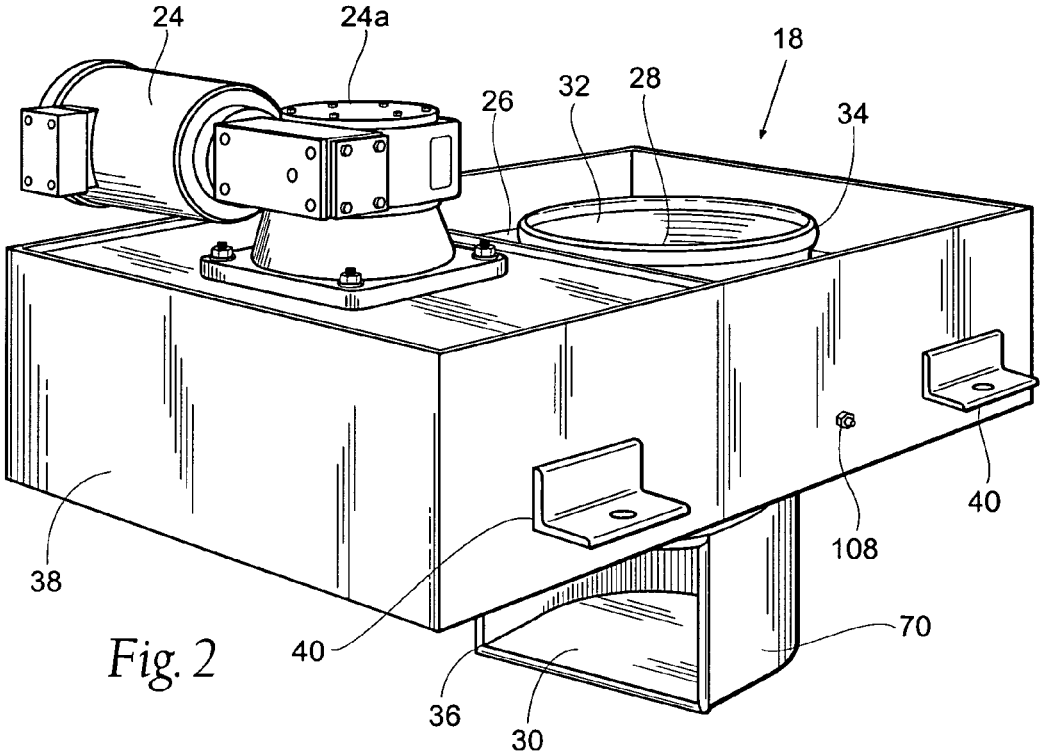
FIG. 2 is a perspective view of the present invention.

FIG. 2 shows a perspective view of the improved feed distributor 18. A power means, such as electric motor 24 of any sufficient design or size that will adequately allow the distributor 18 to operate powers the feed distributor 18. The output of the motor 24 is rotationally coupled to a gear reducer 24*a*, which in turn drives the rotating components of the feed distributor 18.

The feed distributor 18 has three main areas that the rocks will encounter when proceeding towards the crusher 20: a feed platform or box 26, an inlet 28, and an outlet 30. The inlet 28 and the outlet 30 generally are opposing sections of a tubular chute 32 containing a coextensive bore within the chute 32, which will be described in more detail with respect to the subsequent figures. When rocks 12 enter into the distributor 18, as shown in FIG. 1, the rocks 12 fill up the feed platform 26 and some of them drop into the inlet 28. After enough rocks have accumulated on the platform 26, all of the rocks 12 will pass into the inlet 28, further traveling through to the outlet 30, where they will eventually end up in the crusher 20. The inlet 28 includes a reinforced lip 34, which helps to extend the life of the inlet 28. Similarly, a second lip 36 is located around the outlet 30 to also extend the life of the outlet 30 (see FIG. 2). The lips 34 and 36 may be designed in any fashion, such as from a metal rod or similar material that may be welded to the inlet 28 and the outlet 30, which will reduce wear on the inlet 28 and outlet 30.

Again referring to FIG. 2, the feed distributor 18 comprises a housing 38, which prevents dust and other debris from interfering with mechanical components of the feed distributor 18. The housing 38 may be of any shape that will efficiently protect the internal components and not interfere with the functions of the distributor 18. Preferably, the housing 38 is designed so that it substantially seals off the inner parts of the distributor 18 from the outside elements. A plurality of brackets 40 is provided on the outside of the housing 38. The brackets 40 provide an area for the distributor 18 to be mounted onto the frame 19 over the crusher 20 (see FIG. 1). The brackets 40 should be understood to encompass any mounting means that will sufficiently secure the distributor 18 to the crusher 20. Similarly, the brackets 40 together with the frame 19 may be of any design. For instance, the distributor 18 does not necessarily need to be firmly bolted down, but may be held in place with stop blocks (not shown).

The inlet 28 and the outlet 30 comprise the tubular chute 32. Located within the inlet 28 is an optional stationary tube or wear sleeve 62. The stationary tube or wear sleeve 62 preferably extends a distance above the inlet 28 and also a distance below the inlet 28. The reinforced lip 34 formed along the upper edge of the wear sleeve 62 helps to extend the life of the inlet 28. When the wear sleeve 62 is employed in the feed distributor 18, the previously described lip 34 is located at the top of the wear sleeve 62. While the wear sleeve 62 may be secured to the inlet 28, it preferably rests upon the feed platform 26. A laterally extending flange 64 assists in the wear sleeve 62 resting on the feed platform 26. When it becomes worn down, the wear sleeve 62 may be easily removed and replaced with a new sleeve.

Figure 3:
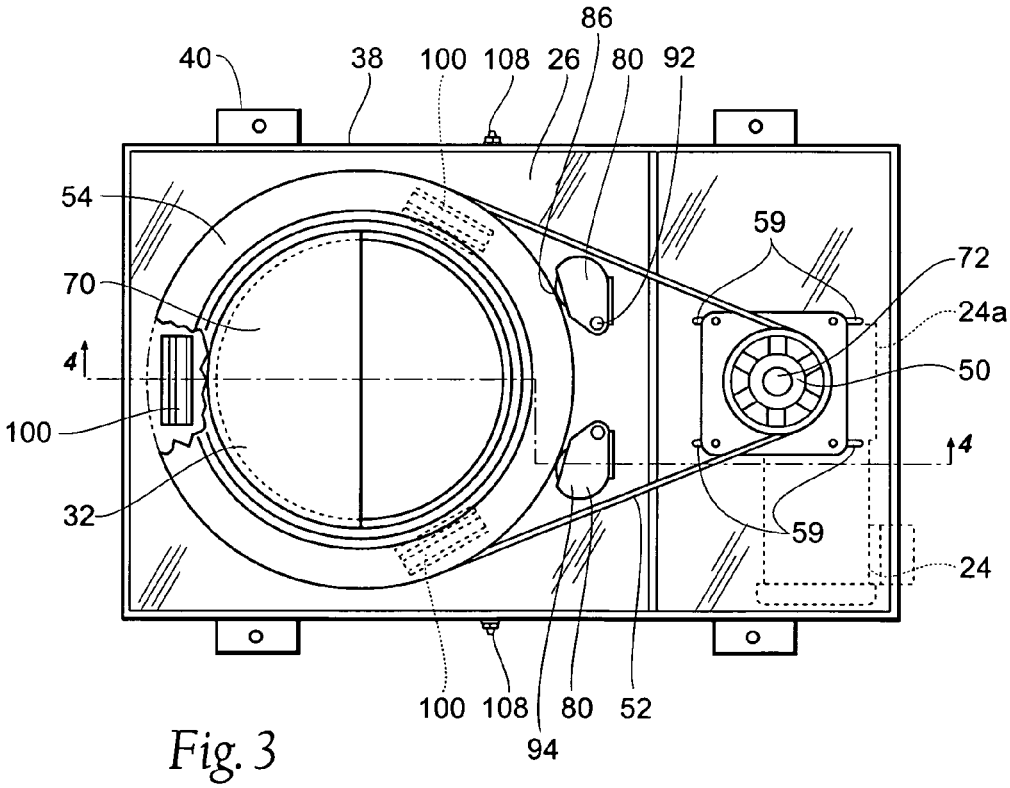
FIG. 3 is a bottom plan view of the present invention.

FIG. 3 shows a bottom view of the improved feed distributor 18. The output shaft 72 of gear reducer 24*a* (shown in phantom) is coupled to one or more drive wheels, sheaves, or pulleys 50, which is connected to one or more drive belts 52. Drive belts 52 are engaged with sheave 50 and with sheave structure 54.

Figure 4:
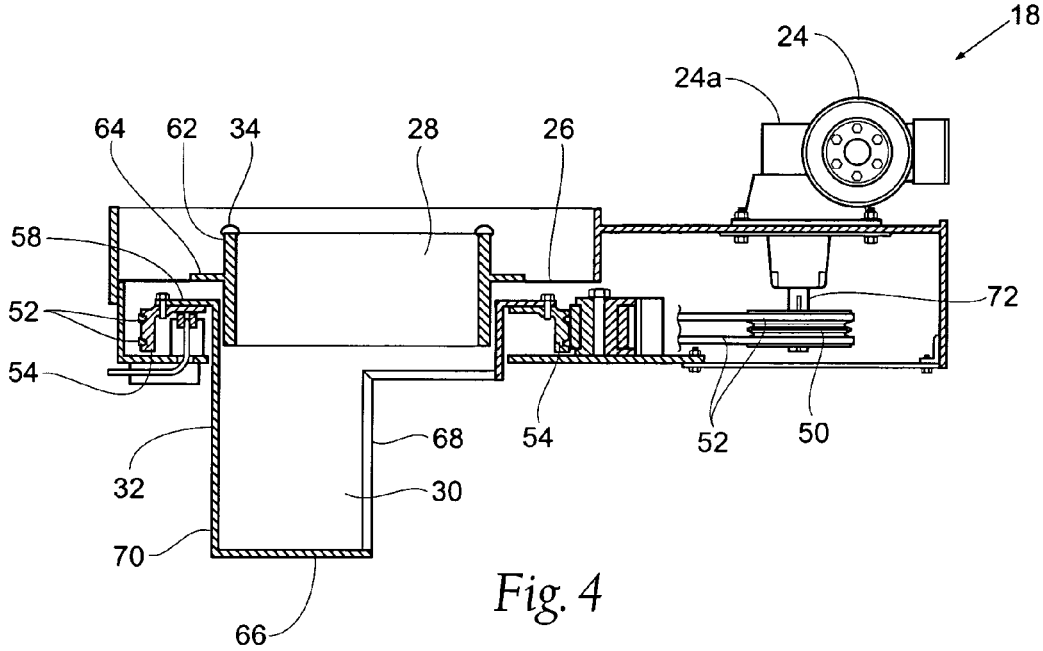
FIG. 4 is a sectional side view of the present invention taken along line 4-4 of FIG. 3.

As shown in FIG. 4, the sheave structure 54 is attached to the tubular chute 32. The drive belts 52 are received into belt receiving grooves 56 on the sheave structure 54. The drive belts 52 are preferably V-belts. The drive belts 52 are tightened by adjusting the distance between the sheave 50 and the sheave structure 54. Once the position of the tubular chute 32 is set (as described below) belt tightening is accomplished by means of slotted openings 59 being formed in the mounting for the gear reducer 24*a* and motor 24 assembly.

As also shown in FIG. 3, the force exerted by the belts 52 about the sheave structure 54 and tubular chute 32 is countered by a pair of idler wheel assemblies 80. Each idler wheel assembly 80 is mounted to the underside of feed platform 26. A idler wheel 86 is rotationally supported by an axle between upper and lower idler brackets. A fastener 92 passes through an offset opening in each of the idler brackets and the feed platform 26 to allow the assemblies 80 to pivot on the feed platform about the axis of the fastener 92. Once the tubular chute 32 is properly positioned within the feed distributor 18, each idler wheel assembly 80 is pivoted such that its idler wheel 86 comes into contact with the face 55 of the sheave structure 54 which is in turn coupled to the tubular chute 32. While not required, a cover 94 may extend about each idler wheel 86 to prevent the build-up of dust and other materials that may adversely affect the performance of the rollers 86 and their bearings 88.

Tubular chute 32 is vertically supported by at least three thrust bearings 100. Each bearing 100 has a bearing surface 102 formed from a composite material commercially known as PEEK. Bearing surfaces 102 support the flange 58 formed on the sheave structure 54 that is coupled to the tubular chute 32.

The platform 26, as shown in FIG. 4, preferably has a square shape, with the inlet 28 and the wear sleeve 62 centered within the platform 26. The height of the platform 26 is shown as being approximately the same height that the wear sleeve 62 extends upwardly from the inlet 28. However, any height that will allow the platform 26 to operate as a rock bed for the feed distributor 18 will suffice.

Further in FIG. 4, the outlet 30 has a base 66, an open side 68, and at least one closed side 70. The open side 68 and the closed side or sides 70 extend laterally upward from the base 66. Preferably, the closed side 70 has a curvilinear shape (see FIGS. 2 and 3), which prevents rocks from unnecessarily building up in the corners of the outlet 30. However, the outlet 30 may have straight sides 70, forming such other geometric shapes, and still fall within the scope of the invention.

The outlet 30 is relatively large, thereby increasing throughput capacity of the distributor 18.

Referring further to FIG. 4, the motor 24 and the gear reducer 24*a* are shown connected to the output shaft 72, which drives the drive wheel or sheave 50. The drive wheel 50 rotates the drive belts 52, which pass around the sheave structure 54 coupled to the tubular chute 32, causing the chute 32 to rotate. As the chute 32 rotates, the wear sleeve 62 preferably remains stationary, which contributes to even wear of the sleeve 62, thereby extending the life of the wear sleeve 62.

Figure 5:
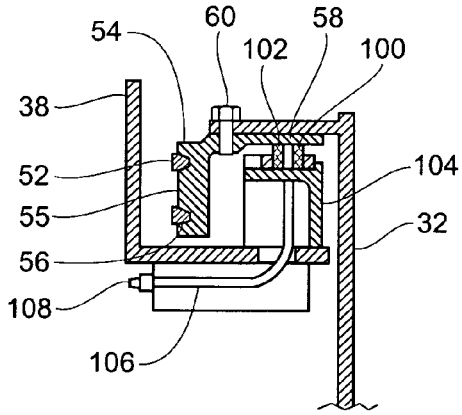
FIG. 5 is a partial cut away sectional side view.

FIG. 5 is a cross-sectional view depicting the relationship between the stationary housing 38, rotating tubular chute 32, sheave structure 54 and a thrust bearing 100 in greater detail. As shown, the sheave structure 54 includes two grooves 56 for receiving the drive belts 52 that rotate the chute 32. The drive belts 52 are preferably v-belts. Sheave structure 54 also includes a horizontal flange portion 58. The sheave structure 54 is coupled to the chute 32 utilizing fasteners 60 as shown. The flange portion 58 has a smooth underside surface that is supported on thrust bearings 100 at bearing surfaces 102. Each thrust bearing 100 is supported on a bearing block or support 104. The bearing blocks 104 are affixed to housing 38. A lubricant line 106 supplies a lubricant, such as grease to the thrust bearing surface 102. Fittings, such as grease fittings 108 are mounted outside the housing 38 so that the thrust bearings 100 can be periodically lubricated without having to remove any components from the feed distributor 18.

While is has been found that the presence of lubricant reduces an audible hum from the feed distributor during operation, it is not necessary to supply lubricant to any of the thrust bearings 100 during operation of the feed distributor 18. In other words, the performance of the feed distributor remains the same with or without the presence of lubricant at the interface of the flange portion 58 and thrust bearing surface 102.

Figure 6:
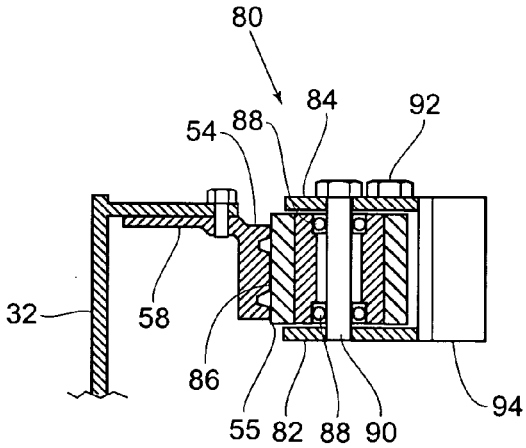
FIG. 6 is another partial cut away section side view.

FIG. 6 is an enlarged cross-sectional view of the relationship between idler wheel assembly 80 and the sheave structure 54. Each idler wheel assembly 80 is mounted to the underside of feed platform 26 (see also FIG. 3). Each assembly 80 includes a lower idler bracket 82, an upper idler bracket 84, a idler wheel 86, a pair of ball bearing assemblies 88, an axle 90 and a fastener 92. The idler wheel 86 is rotationally supported by the axle 90 between the upper and lower idler brackets 84, 82. The fastener 92 passes through an offset opening in the idler bracket 82 and is fastened to the idler bracket 84 through a threaded hole to allow the assemblies 80 to pivot on the base platform about the axis of the fastener 92. Once the tubular chute 32 is properly positioned with respect to the stationary tube 64 and within the feed distributor 18, each idler wheel assembly 80 is pivoted such that its idler wheel 86 comes into contact with the face 55 of the sheave structure 64 coupled to the tubular chute 32. While not required, a cover 94 may extend about each idler wheel 86.

As further shown in FIG. 6, idler wheel 86 makes contact with the vertical face 55 of sheave structure 54 to maintain the predetermined distance between sheave 50 and rotating chute 32 so that the chute is properly centered in the housing 38 and proper tension is maintained by the drive belts 52. It can also be seen that the face 55 of sheave structure 54 is substantially orthogonal to the flange 58 of sheave structure 54.

Figure 7:
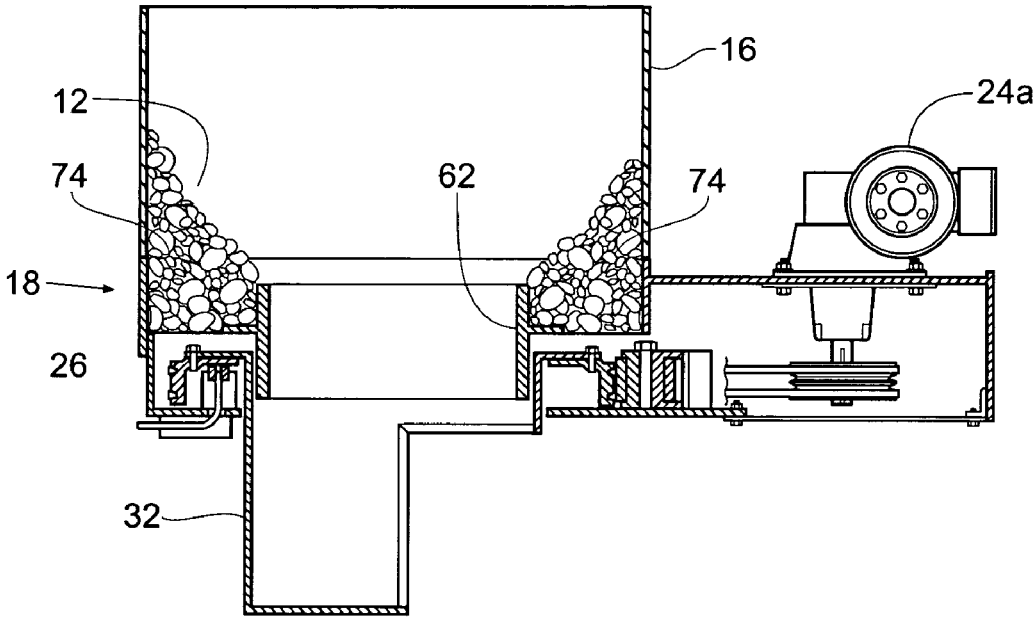
FIGS. 7 and 8 are sectional side views of the present invention, feedbox and rocks.

FIG. 7 shows a side view of the feed distributor 18 after rocks 12 have been fed into the feedbox 16. As previously shown in FIG. 1, the feedbox 16 is located directly over the platform 26. The feedbox 16 securely fits onto the platform 26 in a way that will contribute to the platform 26 acting as an accumulator or "dead bed" 74 for the feed distributor 18. The dead bed 74 decreases wear on the feed distributor 18, the chute 32, and the wear sleeve 62. Because the rocks 12 build up on the platform 26 as opposed to constantly falling down upon the chute 32 and the wear sleeve 62, the wear will be reduced, as there is rock on rock sliding, as opposed to rock on distributor sliding.

Figure 8:
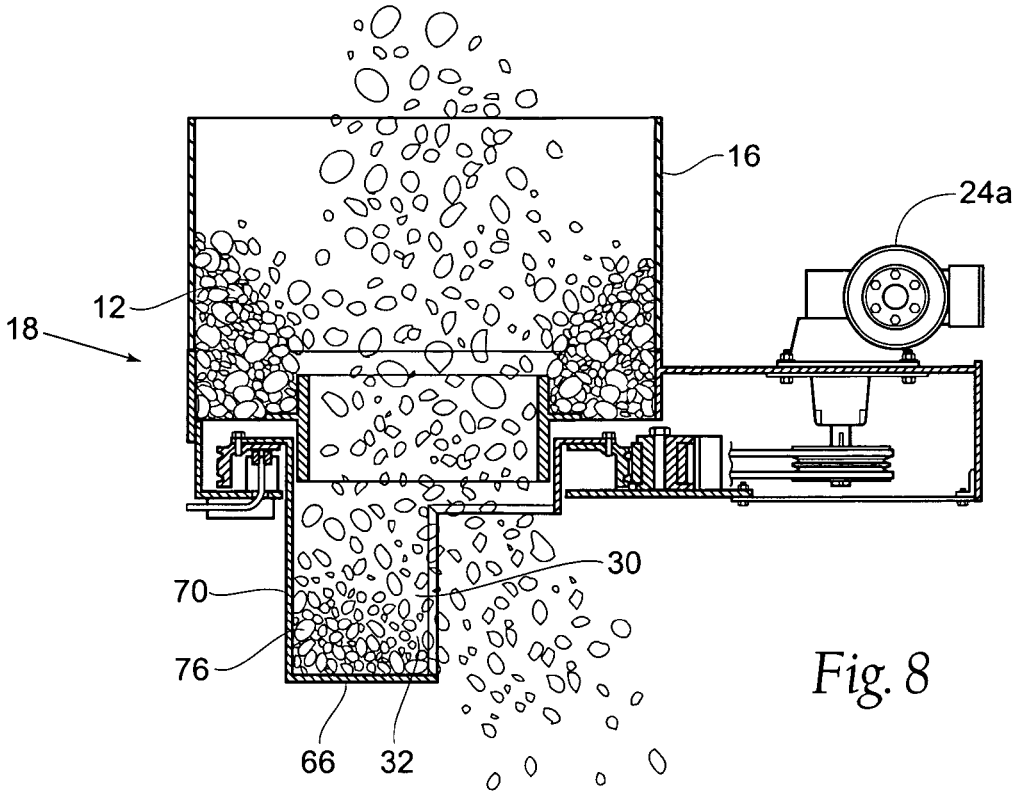

FIG. 8 shows the distributor 18 of FIG. 7 after more rocks 12 have been fed into the distributor 18. A second dead bed 76 is formed in the outlet 30, defined by the base 66 and the closed side 70. The second dead bed 76 further reduces wear on the chute 32 and the base 66. Furthermore, the sloped shape of the dead bed 76 allows the rocks 12 to easily exit the outlet 30 without unnecessary wear on the chute 32. However, the rotation of the chute 32 still provides that the rocks 12 are evenly distributed.

Figure 9:
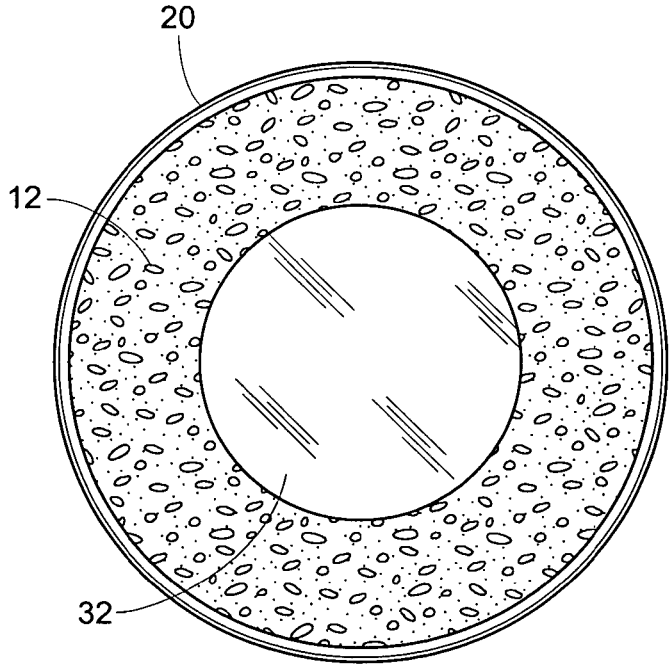
FIG. 9 is overhead view of a crusher used in connection with the present invention.

FIG. 9 shows an overhead view of the crusher 20 and the chute 32. Because of the arrangement of the present design, the rocks 12 are evenly distributed throughout the crusher 20. Because the rocks 12 are fed into the crusher 20 with less size segregation and more uniformity, the crusher 20 will more efficiently crush the rocks 12. Likewise, it is advantageous that the chute 32 is centered over the crusher 20 for further uniformity of the fed rocks 12.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A rotating feed distributor for a rock crusher, said distributor comprising:

a housing;

a rotatable tubular chute for receiving rocks, said chute forming a coextensive bore, said bore having an inlet portion and an outlet portion;

a plurality of thrust bearings mounted to said housing and supporting said chute a power means;

a sheave structure coupled to said chute;

at least one drive belt coupled to said power means and to said sheave structure; and a plurality of idler wheels mounted to said housing circumferentially about said sheave structure.

2. The rotating feed distributor of claim 1 wherein at least one idler wheel is located to maintain a predetermined distance between said chute and said power means.

3. The rotating feed distributor of claim 1 wherein said idler wheels are pivotally mounted to said housing.

4. The feed distributor according to claim 1 wherein said inlet portion includes a tubular wear sleeve, said wear sleeve residing within and coaxially to said bore.

5. The feed distributor according to claim 4 wherein said wear sleeve extends a predetermined distance within said inlet portion.

6. The feed distributor according to claim 4, wherein said wear sleeve further comprises a laterally extending flange, said flange supporting said wear sleeve on said housing.

7. The feed distributor according to claim 1 wherein said outlet portion of said chute comprises a base, an open side, and a closed side, said open and closed sides extending upwardly from base, said open side allowing distribution of said rocks.

8. The feed distributor according to claim 1 further comprising mounting means for supporting said distributor above said crusher.

9. The rotating feed distributor of claim 1 wherein the sheave structure further comprises at least one drive belt receiving groove.

10. The rotating feed distributor of claim 1 wherein the sheave structure further comprises a substantially horizontal flange, said thrust bearings contacting said flange.

11. The rotating feed distributor of claim 1 wherein the sheave structure further comprises a substantially vertical face, said idler wheels contacting said face.

12. The feed distributor according to claim 1 further comprising a feed platform, said feed platform located on said housing around said inlet portion of said chute.

13. A rotating feed distributor for a rock crusher, said distributor comprising:

a housing;

a plurality of thrust bearings coupled to said housing;

a rotatable tubular chute for receiving rocks, said chute forming a coextensive bore, said bore having an inlet portion and an outlet portion;

a power means;

a sheave structure coupled to said chute, said sheave structure having flange arranged to receive said thrust bearings and a face orthogonal to said flange;

a drive belt coupled to said power means and to said sheave structure; and a plurality of idler wheels coupled to said housing and positioned circumferentially relative to said chute, said idler wheels contacting said face of said sheave structure.

14. The feed distributor according to claim 13 wherein said inlet portion includes a substantially coaxial tubular wear sleeve, said wear sleeve residing within said bore.

15. The feed distributor according to claim 14, wherein said wear sleeve further comprises a laterally extending flange, said flange supporting said wear sleeve on said housing.

16. The feed distributor according to claim 13 wherein said idler wheels maintain a predetermined distance between said chute and said power means

17. The feed distributor according to claim 13 further comprising a feed platform, said feed platform located on said housing around said inlet portion of said chute.

18. The feed distributor according to claim 14 wherein said tubular wear sleeve further comprises a section extending upwardly from said inlet portion, said upwardly extending portion further comprising a reinforced lip.

19. The feed distributor according to claim 13 wherein a drive belt receiving groove is formed in said sheave structure.

20. The feed distributor according to claim 13 wherein said idler wheels are pivotally mounted to said housing.

* * * * *